United States Patent [19]

Brown

[11] 3,954,236

[45] May 4, 1976

[54] WIND ACTUATED ROTATABLE TUBULAR DEVICE

[76] Inventor: Roswell F. Brown, 1015 Hinman Ave., Evanston, Ill. 60202

[22] Filed: May 14, 1975

[21] Appl. No.: 577,545

[52] U.S. Cl. ..... 244/155 R; 46/53; 416/9; 416/85

[51] Int. Cl.[2] ..... B64C 31/06

[58] Field of Search ..... 244/155 R, 153 A, 153 R, 244/1 TD, 33, 3; D34/15 AF; 46/53, 56, 57; 40/215; 273/105.3; 416/9, 85

[56] References Cited

UNITED STATES PATENTS

| | | | |
|---|---|---|---|
| 2,151,349 | 3/1939 | Fromme | 244/153 A |
| 2,835,462 | 5/1958 | Martin | 244/153 A |
| 3,091,420 | 5/1963 | Deguin | 244/155 R |

*Primary Examiner*—Trygve M. Blix
*Assistant Examiner*—Barry L. Kelmachter
*Attorney, Agent, or Firm*—Max R. Kraus

[57] ABSTRACT

A wind actuated rotatable tubular device comprising a generally tubular member formed of a collapsible and flexible material having an inlet opening at one end and an outlet opening at the other end thereof with rigid rods secured to said tubular member to define the inlet and outlet openings and with a blade-like member secured across at least one of said openings. A flexible line is attached to the rods at the inlet opening centrally of said opening with the opposite end of the flexible line attached to an anchoring member so that the wind passing through the tubular member will strike and impinge against the blade-like member to cause the tubular member to rotate with respect to the anchoring member.

6 Claims, 5 Drawing Figures

WIND ACTUATED ROTATABLE TUBULAR DEVICE

BRIEF SUMMARY OF THE INVENTION

One of the objects of this invention is to provide a tubular device, the rotation of which is actuated by the wind and which can be attached to an anchoring member, such as the kite line of a kite in flight, or to a moving plane or boat, or to a fixed pole, or it can be used and flown as a kite.

Another object of this invention is to provide a device of the foregoing character in which the components can be shipped in a knock-down condition to occupy a minimum of space in a container or package and which can be readily assembled at the point of use and be made to operate in a manner that will be interesting to an observer. It can also be readily disassembled for storage after use thereof and reassembled for subsequent use.

Another object of this invention is to provide a tubular device formed of a flexible plastic material which is readily collapsible to a minimal size and which has dowels or rods which are detachably secured to the inlet and outlet ends of the flexible tubular member so that it maintains the inlet and outlet ends of the tubular member in open position, with the dowels or rods at the outlet end supporting fan blades so that when the device is secured to a kite line or to any other anchoring member the wind will enter at the inlet opening of the tubular member and as it passes through and impinges against the fan blades it will cause the tubular member to rotate with respect to the kite line or anchoring means to provide a very interesting and stimulating sight to the observer. The wind actuated rotatable tubular member can by itself be used and flown as a kite.

Another object of this invention is to provide a device having the foregoing characteristics which can be economically produced and can be packaged and shipped in a knock-down condition and readily assembled at the point of use. While the device has particular application to kites it is not limited thereto.

The wind actuated rotatable tubular device forming this invention is indicated generally at 10 and is shown attached to the line 12 of a kite 13 in flight since this is its best application and therefore would have a greater universal appeal. However, this device can be attached and towed by a plane or a boat or anchored to a stationary post, or it can be itself used and flown as a kite by the use of a line similar to a kite line. The term "anchoring member" will apply to any of the aforementioned without limiting the invention herein.

Figure 1:
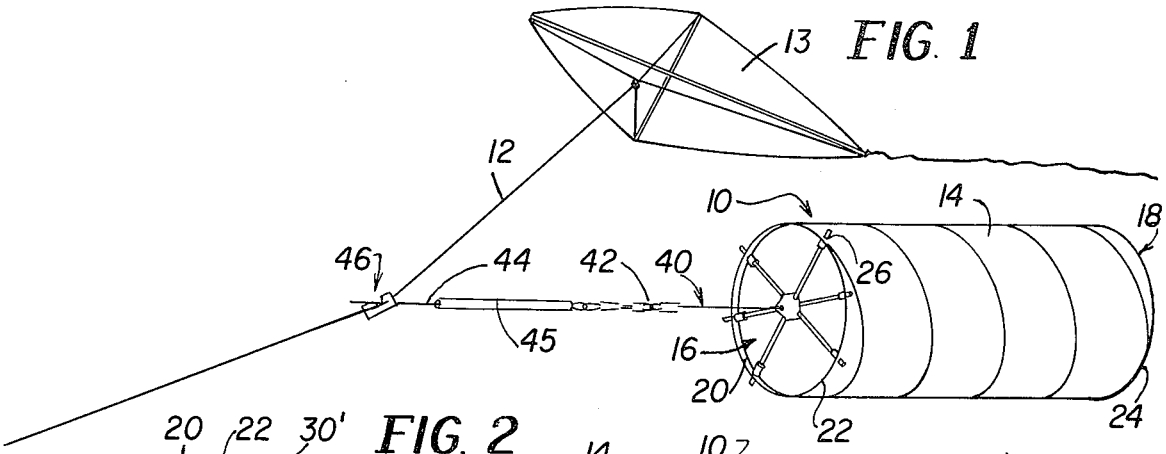
FIG. 1 is a view of the device of this invention shown anchored to a kite line.
Figure 2:
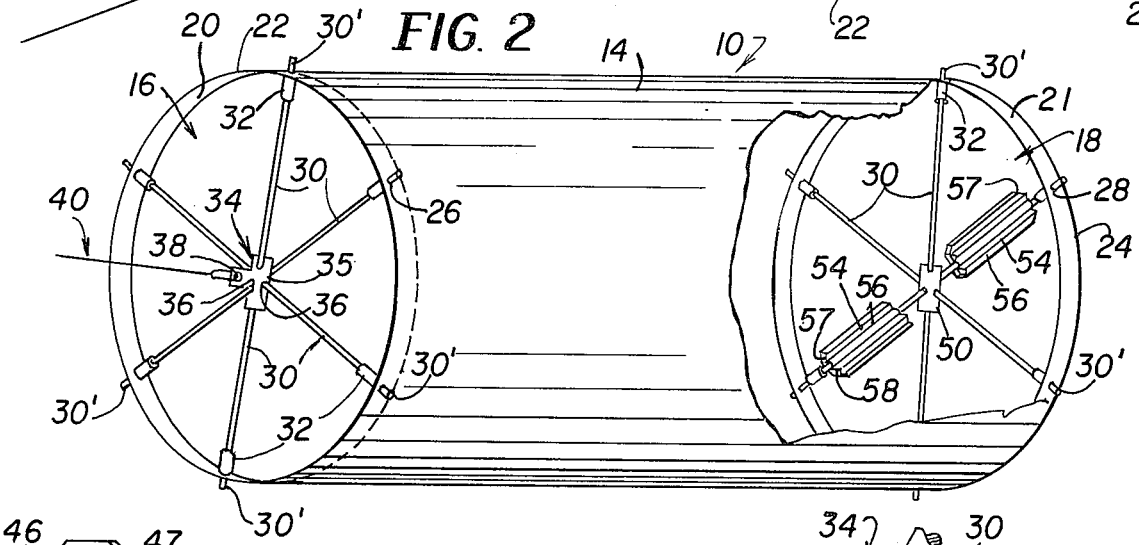
FIG. 2 is a view of the device as it appears when actuated by the wind.
Figure 3:
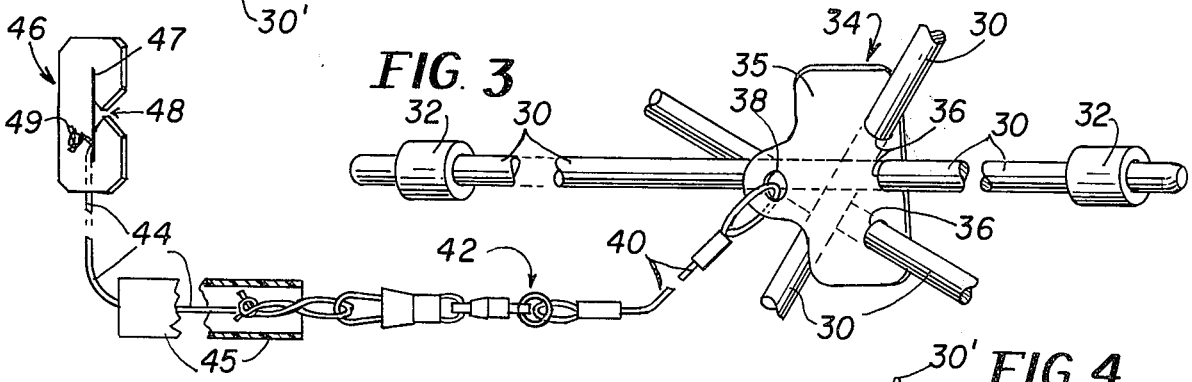
FIG. 3 is an enlarged view showing the parts at the front end whereby it is attached to a kite line or anchoring member.

The device comprises a generally tubular member 14 formed of a flexible material such as polyethylene. The tubular member is defined as "tubular" in its extended or in-flight condition but when collapsed folds flat to occupy a minimum of space. It will be described in its extended or in-flight condition, as shown in FIGS. 1 and 2. The tubular member 14 is open at its opposite ends, namely, the front end 16 and the rear end 18 and the opposite end edges of said tubular member are each covered and reinforced by a clear glass fiber tape 20 and 21 which extends around the front and rear end edges 22 and 24 respectively. The front and rear end edges 22 and 24 are each provided with spaced openings 26 and 28 respectively which are adapted to receive their respective dowel rods which may be formed of wood or plastic.

Each of the dowel rods 30 have at the front end tubular members or sleeves 32 secured thereon which serve as stops and which are spaced from the opposite ends of the dowel rods to provide dowel rod tips 30' at each of the opposite ends of each rod, which dowel rod tips are inserted in the openings 28 for the purpose of holding the tubular member in open-ended position. The stops 32 may be sleeves which are slipped on the ends of the dowel rods, or if the rods are molded of plastic the stop means may be integrally formed flanges which serve as stop means. A minimum of two rods, and preferably three as shown, are arranged at each of the opposite ends.

The three dowel rods 30 at the front or inlet end are centrally connected to each other as generally indicated at 34 so that they in effect form radially extending spokes when attached to the tubular member 14, as shown in FIGS. 1 and 2. One way of forming the means for connecting the three rods is to wrap a strip of fiberglass tape 35 around one of the rods with the opposite sides of said tape secured together to form a strip and provide spaced openings 36 in the strip to receive the other two dowel rods. The strip 35 is flexible so that the rods can be moved or positioned with respect to each other as shown at the front end of tubular member 14 in FIG. 2 or the rods when detached from the tubular member may be positioned next to each other in a minimum of space. The connecting strip 35 has another opening 38 to which the end of a flexible line generally indicated at 40 is permanently secured. The end of the flexible line 40 may be knotted or otherwise permanently secured to the connecting strip. When the dowel rods 30 are secured in the front end 16 of the tubular member 14 a portion of the flexible connecting strip will extend forwardly of the tubular member, as best seen in FIG. 2.

The flexible line 40 is looped and connected at the other end to a conventional swivel member generally indicated at 42 which may be any conventional form of swivel device such as a fish-line leader swivel or may be a piece of ball chain. Connected to the opposite end of the swivel member 42 is another flexible line 44 which is positioned within a substantially rigid sleeve 45 through which it extends, with the opposite end of the flexible line 44 connected to a clip member generally indicated at 46 which may be made of plastic and provided with a longitudinal slot 47 which communicates with a central entrance transverse opening 48. The end of the line 44 is slipped in through the entrance opening 48 and is secured to one end of the longitudinal slot 47, with the end of the line 44 being knotted as at 49 to secure it to the clip 46. The opposite end of the longitudinal slot 47 is used for detachably securing the clip 46 to a kite line 12 or to any other anchoring member. The clip 46 is preferably secured to the kite line twenty or thirty feet from the kite and when so secured the clip maintains a fixed position relative to the kite line and does not slide up or down thereon, therefore, the device of this invention is anchored at a fixed point.

Figure 5:
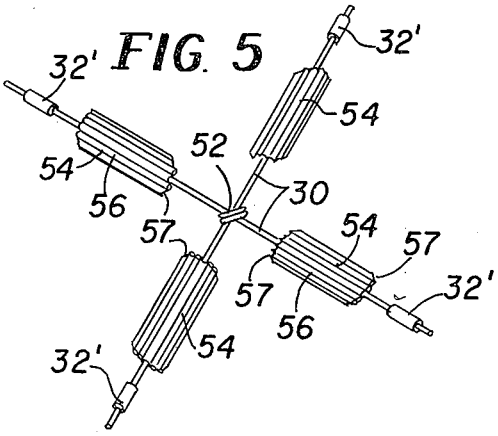
FIG. 5 is a view of a modification showing a pair of dowel rods centrally secured by a rubber band.
Figure 4:
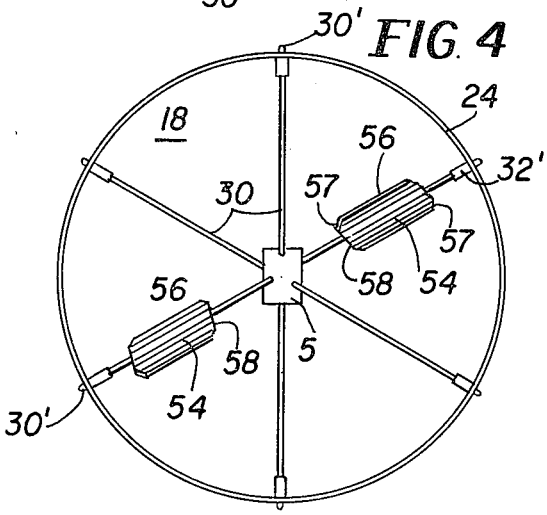
FIG. 4 is a plan view of the rear end of the device.

The outlet end 18 of the tubular member 14 has a plurality, preferably three, dowel rods 30, as shown in FIGS. 2 and 4, centrally connected to each other as generally indicated at 50 which may be similar to the flexible connector strip 35 previously described or by any other means such as a rubber band wound thereon so that they can be moved relative to each other to assume the position shown in FIGS. 2 and 4 in which they are equally spaced from each other to maintain the outlet opening 18 of the tubular member 14 in its configured extended shape as shown. As shown in FIG. 5, two rods 30 are used and they are centrally connected by a rubber band 52. These rods also have stop means 32′ with the dowel rod tips 30′ exposed so that they are inserted in the openings 28 in the rear edge of the tubular member 14. One or more of said dowel rods is provided with blade-like members generally indicated at 54. Each of the blade-like members may be a strip of conventional corrugated board 56 which is light in weight but has sufficient rigidity to maintain its shape. The corner edges of the strip are angled as at 57. The strip of corrugated board 56 is generally flat but has a series of spaced longitudinally extending pockets 58 and said corrugated strip 56 is slipped on to the rod by using the central pocket of each strip. Once slipped on the dowel rod the blade-like member will maintain its fixed position on the rod. Two of such blade-like members 54 are positioned on a rod, one adjacent each of the opposite ends of the rod. As shown in FIGS. 2 and 4, only one of the dowel rods has two blade-like members, whereas in FIG. 5, two of the rods each have a pair of blade-like members, although it will be understood that all three dowel rods may have similar blades. The blades 54 are positioned at an angle of 45° and they serve as a propeller.

With the tubular device 14 anchored to a kite string 12, or the like, the wind will enter through the inlet or front end 16 of the tubular member 14 and will pass through the tubular member and impinge or strike the propeller blades 54 at the outlet or rear end 18. This causes the tubular member 14 to rotate relative to the anchoring kite line. The swivel connector 42 permits the continuous rotation of the tubular member 14. The sleeve 45 on the flexible line 44 prevents tangling of the line. Bell wire may also be used as the line.

The tubular member 14 being of a flexible plastic material can be of one color or a combination of colors and can have distinctive designs imprinted thereon, for example, a barber pole design as shown in FIG. 1 is preferred, and when same is rotating it presents an attractive and pleasing and interesting sight to the observer. While the invention herein is shown attached to a kite line, it can be by itself used and flown as a kite. For example, a flexible line like kite line 12 can be attached to the swivel member 42, with the end of the line held in the hand, and the device can be flown as a kite without the use of a kite like kite 13 and when so flown it will rotate in the manner previously described and will serve as the kite.

What we claimed is:

1. A knock-down wind actuated rotatable tubular device comprising, a generally tubular member formed of a collapsible and flexible material having an inlet opening at one end and an outlet opening at the other end thereof, rigid means defining said inlet and outlet openings, said rigid means comprising rods which are detachably secured to said tubular member, said rods at said outlet end having a plurality of generally flat blade-like members secured thereto, said rods at said inlet end being connected to each other and said rods at said outlet end being connected to each other, each of said rods having stop means positioned adjacent its opposite ends but spaced from the ends of respective rods to provide tips on said rods which tips fit in openings in said tubular member for holding said tubular member in expanded or extended position, means for attaching said tubular member to an anchoring member so that the wind passing through said tubular member will strike and impinge against said blade-like member to cause said tubular member to rotate with respect to said anchoring member.

2. A knock-down wind actuated rotatable tubular device comprising, a generally tubular member formed of a collapsible and flexible material having an inlet opening at one end and an outlet opening at the other end thereof, rigid means defining said inlet and outlet openings, said rigid means comprising rods which are detachably secured to said tubular member, said rods at said outlet opening having a blade-like member, a flexible line attached to said rods at said inlet opening and detachably secured to a kite line of a kite in flight to hold said device in spaced relation to a kite in flight, swivel means connected to said flexible line so that the wind passing through said tubular member will strike and impinge against said blade-like member to cause said tubular member to rotate with respect to said kite line.

3. A knock-down wind actuated rotatable tubular device comprising, a generally tubular member formed of a collapsible and flexible material having an inlet opening at one end and an outlet opening at the other end thereof, rigid means defining said inlet and outlet openings, said rigid means comprising rigid rods which are detachably secured to said tubular member, said rigid rods spanning said inlet and outlet openings, with said rigid rods at said inlet and outlet openings being connected respectively to each other only through said tubular member, said rigid rods at at least one of said inlet and outlet openings having a blade-like member, a flexible line attached to said rigid rods at said inlet opening centrally of said inlet opening with said flexible line secured to a kite line of a kite in flight to hold said device in spaced relation to a kite in flight so that the wind passing through said tubular member will strike and impinge against said blade-like member to cause said tubular member to rotate with respect to said kite line through said flexible line.

4. A device as set forth in claim 3 in which the rods at the inlet end are connected to each other and the rods at the outlet end are connected to each other and each of the rods has stop means positioned adjacent its opposite ends but spaced from the ends of respective rods to provide tips on said rods which tips fit in openings in the tubular member for holding said tubular member in expanded or extended position.

5. A device as set forth in claim 3 in which a portion of said flexible line is positioned within a substantially rigid sleeve member.

6. A device as set forth in claim 3 in which a clip is secured to one end of the flexible line with said clip having a slot whereby it is slipped on to the kite line to hold said clip in fixed position relative to the kite line.

* * * * *